US008393893B2

(12) United States Patent
Schröder et al.

(10) Patent No.: US 8,393,893 B2
(45) Date of Patent: Mar. 12, 2013

(54) ROTARY FURNACE BURNER

(75) Inventors: Ernst Schröder, Büllingen (BE); Alexander Knoch, Lohmar (DE)

(73) Assignee: KHD Humboldt Wedag GmbH, Koeln (DE)

( * ) Notice: Subject to any disclaimer, the term of this patent is extended or adjusted under 35 U.S.C. 154(b) by 723 days.

(21) Appl. No.: 12/520,661

(22) PCT Filed: Dec. 20, 2007

(86) PCT No.: PCT/EP2007/011247

§ 371 (c)(1),
(2), (4) Date: Jun. 22, 2009

(87) PCT Pub. No.: WO2008/077576

PCT Pub. Date: Jul. 3, 2008

(65) Prior Publication Data

US 2010/0019063 A1 Jan. 28, 2010

(30) Foreign Application Priority Data

Dec. 22, 2006 (DE) ..... 10 2006 060 867

(51) Int. Cl.

| | |
|---|---|
| ***F24D 17/01*** | (2006.01) |
| *F24C 6/04* | (2006.01) |
| *F23G 7/12* | (2006.01) |
| *F23G 5/20* | (2006.01) |

(52) U.S. Cl. ..... 431/182; 431/181; 431/183; 431/186; 431/187; 431/189; 110/260; 110/261; 110/347; 60/286; 60/295; 60/297

(58) Field of Classification Search ..... 431/182, 431/181, 183, 186, 187, 189; 110/260–264, 110/347; 60/286, 295, 297; *F24C 6/04; F23D 17/00, 1/00; F23G 7/12, 5/20*
See application file for complete search history.

(56) References Cited

U.S. PATENT DOCUMENTS 3,533,717 A * 10/1970 Guerin ..... 431/182
4,517,905 A * 5/1985 Chastain et al. ..... 110/346
(Continued)

FOREIGN PATENT DOCUMENTS

AT 410 584 B 6/2003
AT 411 928 B 7/2004
(Continued)

*Primary Examiner* — Steven B McAllister
*Assistant Examiner* — Daniel E Namay
(74) *Attorney, Agent, or Firm* — Greer, Burns & Crain, Ltd.

(57) ABSTRACT

In order to provide a rotary-furnace burner in which the quantity fraction of cost-effective particulate secondary fuels to be used as energy carriers can be increased and the configuration of the burner flame can be influenced, even during the operation of the burner, it is proposed, according to the invention, to arrange an expansion chamber open towards the burner mouth and having a widened cross section, as compared with the tube or individual tubes in the burner in front of the issue of the tube or tubes for blowing out the secondary fuels, and to make the axial length and the volume of the expansion chamber variable, during the operation of the burner, by means of the axial displacement of the secondary-fuel tubes, so that the particulate secondary fuel particles blown out at the burner mouth with a considerably reduced velocity do not fly past the burner flame, but, instead, burn out in the flame.

3 Claims, 1 Drawing Sheet

U.S. PATENT DOCUMENTS

| | | | | |
|---|---|---|---|---|
| 4,589,355 | A * | 5/1986 | Chastain et al. | 110/346 |
| 4,679,512 | A * | 7/1987 | Skoog | 110/347 |
| 4,775,314 | A * | 10/1988 | Sternling | 431/4 |
| 5,169,304 | A * | 12/1992 | Flament et al. | 431/183 |
| 5,178,533 | A * | 1/1993 | Collenbusch | 431/8 |
| 5,199,355 | A * | 4/1993 | Larue | 110/261 |
| 6,142,765 | A | 11/2000 | Ramaseder et al. | |
| 6,315,551 | B1 * | 11/2001 | Salzsieder et al. | 431/183 |
| 6,461,148 | B1 * | 10/2002 | Scotto et al. | 431/215 |
| 6,968,692 | B2 * | 11/2005 | Chin et al. | 60/737 |
| 6,969,249 | B2 * | 11/2005 | Marino et al. | 431/9 |
| 7,267,809 | B2 * | 9/2007 | Ranke et al. | 423/449.1 |
| 2001/0007233 | A1 * | 7/2001 | Mukai et al. | 110/347 |
| 2010/0167054 | A1 * | 7/2010 | Hagihara et al. | 428/402 |

FOREIGN PATENT DOCUMENTS

| | | | |
|---|---|---|---|
| DE | 43 19 363 | | 12/1994 |
| EP | 0 628 768 | | 3/1997 |
| EP | 1725811 | | 11/2005 |
| JP | 2000327378 | A * | 11/2000 |
| JP | 2001200308 | A * | 7/2001 |
| JP | 2002139212 | A * | 5/2002 |
| WO | WO 97/09566 | | 3/1997 |
| WO | WO 2005/085707 | | 9/2005 |

* cited by examiner

ROTARY FURNACE BURNER

BACKGROUND OF THE INVENTION

The invention relates to a burner for a rotary tubular furnace for the production of cement clinker, with a duct, arranged annularly within a burner carrier tube, for the discharge of primary fuels, for example coal dust, with at least one annular primary-air duct and with at least one tube, integrated in the burner, for the pneumatic transport of particulate secondary fuels and for the blowing these out at the burner mouth.

In a cement clinker production line, calcined raw cement meal is burnt in the sintering zone of a rotary tubular furnace into cement clinker. To heat the rotary tubular furnace, a long burner lance is introduced into the furnace outflow end through the stationary furnace outflow housing, at the mouth of which burner lance the fuels introduced into the lance burn so as to form a burner flame. The correct temperature, the length and the other configuration of the burner flame are important in the formation of clinker minerals in the rotary tubular furnace. Development tends to give the rotary tubular furnace itself as short a build as possible by virtue of high-quality calcination of the raw cement meal outside the rotary tubular furnace, so that, in reaction to this, the burner flame is, as a rule, to be as short and as hot as possible. Increasingly often, instead of liquid and gaseous fuels, the fuels used are solid fuels, in particular coal dust, but, recently, also pneumatically transportable particulate waste fuels, such as, for example, waste plastic granulates, etc., as secondary fuels.

Known rotary-furnace burners are often designed as what are known as three-duct burners (for example DE 43 19 363 A1), with at least three ducts concentric to one another, that is to say the pneumatically transported coal dust flows as fuel through the middle burner duct and emerges through an annular gap nozzle, the outflowing coal dust being surrounded by radially inner and by radially outer primary air as combustion air. The radially outer air, also called jet air, is subdivided, by means of a multiplicity of individual nozzles arranged in the annular jet-air duct, into a large number of individual high-velocity primary-air jets which generate a vacuum zone in their surroundings, that is to say the many high-velocity primary-air jets serve as propulsive jets on the injector principle, by virtue of which the large mass of the virtually stationary hot secondary air of, for example, about 1000° C., which surrounds the rotary-furnace burner, is sucked inwards in the direction of the core of the burner flame, where an intensive intermixing of the hot secondary air with the coal dust emerging through the annular gap nozzle takes place, the intention being that the coal dust should bum quickly and completely so as to form a short hot flame.

In the known three-duct burner, it would not be possible to inject particulate secondary fuel through the coal dust duct by means of its annular gap nozzle, since this secondary fuel would block the annular gap nozzle. Attempts have therefore already been made to blow through the central tube of the burner, into which a central ignition burner can be inserted, particulate secondary fuel which then emerges, however, as a compact jet, in which the particular fuel fans out a little, flies too far in the rotary tubular furnace, forms too long a flame and does not bum out or bums out too late. Furthermore, attempts have been made to set the injected secondary fuels in rotation at the mouth of the burner lance, the result of this being that, in particular, the large secondary fuel particles of high specific gravity are thrown onto the periphery, in any event are thrown out of the flame cone, instead of burning in the flame.

SUMMARY OF THE INVENTION

The object on which the invention is based is to provide a rotary-furnace burner, in which the quantity fraction of cost-effective secondary fuels to be used as energy carriers can be increased and the configuration of the burner flame can be influenced.

In the burner according to the invention, an expansion chamber, open towards the burner mouth and having a widened cross section, as compared with the secondary-fuel tube, is arranged in front of the issue of the at least one tube for blowing out the particulate secondary fuels in the burner. That is to say, the pneumatically transported particulate secondary fuels injected by one or more injection tubes first enter an expansion chamber of widened cross section, out of which the particulate secondary fuels preoxidized with a prolonged dwell time then flow at the burner mouth into the flame cone of the burner flame with a considerably reduced velocity. The risk that the particles of the secondary-fuel jet fly, unburnt, past the burner flame is minimized. In any event, in the burner according to the invention, the quantity fraction of cost-effective secondary fuels which can be used as energy carriers can be increased markedly and part of the comparatively costly primary fuel can be saved.

The axial length of the expansion chamber can be varied, during the operation of the burner, by means of the axial displacement of the secondary-fuel tube or tubes. Consequently, the volume of the expansion chamber, the preoxidation of the particulate secondary fuels in the expansion chamber, the reduction in flow velocity in the expansion chamber and the spatial angle of emergence of the secondary-fuel jet can be influenced in such a way that the particulate secondary fuels burn out within the burner flame with the desired flame configuration.

According to a particular feature of the invention, a specific swirl generator may be arranged at the issue of the secondary-fuel tube or tubes into the expansion chamber in order to swirl the secondary fuels already in the expansion chamber. In this case, the swirl generator may consist of a component which is attached to the issue of the secondary-fuel tube or tubes and through which the secondary fuels flow and which has swirl slots which are distributed over the circumference, through which swirl slots additional primary air blown through the burner flows, which primary air transmits its rotary momentum in the expansion chamber to the blown-out secondary fuels. Owing to the rotary momentum of the particulate secondary fuels, the mixing of these into the burner flame can be assisted. Moreover, in this way, too, the burner-flame configuration desired in each case can always be set.

BRIEF DESCRIPTION OF THE DRAWINGS

The invention and its further features and advantages are explained in more detail by means of the exemplary embodiments illustrated diagrammatically in the figures in which.

DETAILED DESCRIPTION OF THE DRAWINGS

Figure 2:
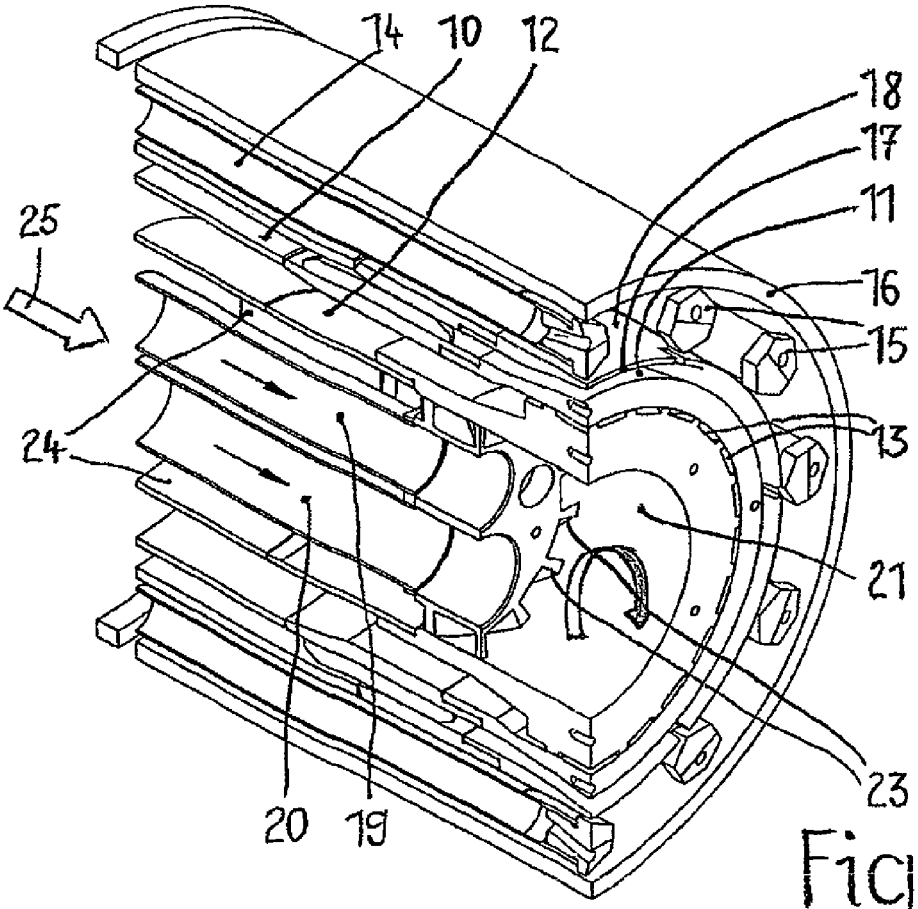
FIG. 2 shows, enlarged and in perspective, a detail of the axial section through the burner mouth, partially in an end view.

The rotary-furnace burner according to the invention is described first, by means of FIG. 2, as a three-duct burner with an annularly arranged duct 10 for the pneumatic transport of a fine-grained solid fuel, such as, for example, coal dust, which flows out through an annular gap nozzle 11 at a small angle diverging outwards. The coal dust duct 10 is surrounded concentrically both by a radially inner and a radially outer combustion-air duct, these combustion-air streams forming the primary air for the burner. The primary-air duct 12 arranged concentrically within the coal dust duct 10 is equipped at its issue with a swirl generator 13, for example with swirl slots, so that this radially inner primary-air duct is also called a swirl-air duct. The radially outer primary air, also called jet air, is supplied via jet-air tubes 14 arranged so as to be distributed axially parallel around the burner axis, and it emerges at high velocity in the form of nozzle jets from individual jet-air nozzles 15 which are arranged so as to be distributed around the circumference of the burner mouth and of which there are, for example, 12. The high-velocity jet-air jets which are capable of sucking in as much as possible of the hot secondary air of, for example 1000·degree·C., surrounding the rotary-furnace burner in the rotary tubular furnace, into the core of the burner flame for the purpose of rapid and complete fuel combustion should impinge upon the fuel cone or the burner flame at an optimal point for the purpose of achieving high flame turbulences.

In the annular space between the outer burner carrier tube 16 and the coal dust tube 17 arranged concentrically to it, cooling air is blown through the burner and flows out at the burner mouth in the region between the adjacent jet-air nozzles 15, where the cooling air heated at the burner lance then forms a fraction of the primary air. The annular cooling-air duct is designated by the reference numeral 18. The burner carrier tube 16 is in any event protected in the front burner-lance region by an attached refractory compound, not illustrated in FIG. 2.

According to the exemplary embodiment of FIG. 2, for example, two tubes 19, 20 for the pneumatic transport and blow-out of particulate alternative fuels or secondary fuels at the burner mouth are introduced into the central tube of the burner, into which a central ignition burner can be inserted in the case of a conventional burner. An expansion chamber 21 open towards the burner mouth and having a widened cross section, as compared with the tube cross sections, is arranged in the burner in front of the issue of the tubes 19, 20 for blowing out the secondary fuels. That is to say, in the rotary-furnace burner according to the invention, the particulate secondary fuels 25 injected via the tubes 19, 20 are first caused to emerge into the expansion chamber 21, out of which the particulate secondary fuels preoxidized there with a prolonged dwell time then enter the flame cone of the burner flame at the burner mouth with a markedly reduced velocity, the risk of particulate secondary fuel particles flying past the flame being minimized. Consequently, in the rotary-furnace burner according to the invention, the quantity fraction of cost-effective particulate secondary fuels, such as, for example, waste plastic granulates, which can be used as energy carriers can be increased considerably, and part of the comparatively costly primary fuel, for example coal dust, can be saved.

Figure 1:
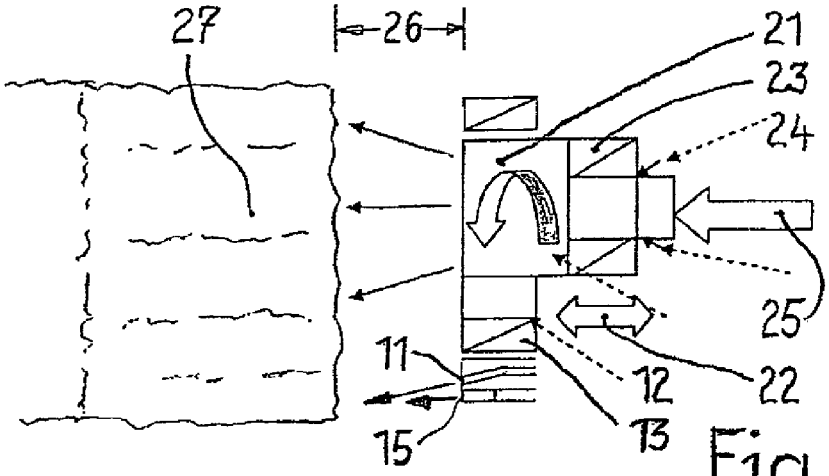
FIG. 1 shows diagrammatically an axial section through the center of the mouth of the rotary-furnace burner according to the invention with particulate secondary fuels used.

As a result of axial displacement of the secondary-fuel tubes 19, 20 which is indicated in FIG. 1 by the double arrow 22, the axial length and the volume of the expansion chamber 21 can be varied while the burner is in operation. Thus, the velocity of emergence, the flight length and the preoxidation of the particulate secondary fuel particles blown out of the burner mouth and also the configuration of the burner flame can be influenced.

The mixing of the blown-out particulate secondary fuels into the burner flame and their configuration can also be influenced in that a specific swirl generator 23 is arranged at the issue of the secondary-fuel tubes 19, 20 into the expansion chamber 21 in order to swirl the secondary fuels already in the expansion chamber 21. According to the exemplary embodiment of FIG. 2, this swirl generator 23 consists of a component which is attached to the issues of the secondary-fuel tubes 19, 20 and through which the secondary fuels flow and which has swirl slots which are distributed over the circumference, through which swirl slots additionally primary air blown through the burner flows, which primary air is introduced into the burner via the annular duct 24 and transmits its rotary momentum in the expansion chamber 21 to the blown-out particulate secondary fuels. This measure, too, contributes, in the rotary-furnace burner according to the invention, to ensuring that the comparatively large quantity of particulate secondary fuels to be used does not fly past the burner flame in an undesirable way, but, instead, bums out in the burner flame.

In the diagrammatic illustration of FIG. 1, the particulate secondary fuels introduced into the rotary-furnace burner according to the invention are symbolized, as in FIG. 2, by the large arrow 25. Furthermore, it is illustrated diagrammatically there that the desired distance 26 from the start of the flame root 27 to the burner mouth can also be set, even during the operation of the burner, in a range of about 300 to about 800 mm with the aid of the adjustable axial length of the expansion chamber 21 and of the rotary momentum of the blown-out secondary fuels and, if appropriate, as a function of further parameters.

In any event, the rotary-furnace burner according to the invention is suitable for reducing the quantity fraction of relatively costly primary fuel, for example coal dust, used as solid fuel or even oil and, instead, for increasing the quantity fraction of cost-effective alternative fuels, such as particulate waste fuels, such as, for example, waste plastics, pneumatically transportable sewage sludges, etc.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A rotary tubular furnace with an annular duct for transporting primary fuels which duct flows out through an annular gap nozzle at a small angle diverging outwards of the rotary tubular furnace, and is surrounded concentrically both by a radially inner and a radially outer combustion air duct for combustion-air streams, these combustion-air streams forming the primary air for the burner and the radially inner combustion air duct is equipped at its issue with a swirl generator and the outer combustion air duct supplies primary air axially parallel around the burner axis, comprising:

at least one tube for the pneumatic transport and blow-out of particulate secondary fuels provided in a central tube of the rotary tubular furnace and arranged in an expansion chamber having a widened cross section, as compared with the tube cross section and the axial length and the volume of the expansion chamber being variable during the operation of the rotary tubular furnace wherein the particulate secondary fuels blown out from at least one tube enter the flame cone of the burner lance with a reduced velocity due to the effect of the expansion chamber.

2. A rotary tubular furnace according to claim 1, wherein a swirl generator is arranged at the issue of the secondary-fuel tube or tubes into the expansion chamber in order to swirl the secondary fuels already in the expansion chamber.

3. A rotary tubular furnace according to claim 2, wherein the swirl generator comprises a component which is attached to the issue of the tube or tubes and through which the secondary fuels flow and which has swirl slots which are distributed over the circumference, through which swirl slots additional primary air blown through the burner flows, which primary air transmits its rotary momentum in the expansion chamber to the blown-out secondary fuels.

* * * * *